US006282855B1

(12) United States Patent
Shipton

(10) Patent No.: US 6,282,855 B1
(45) Date of Patent: Sep. 4, 2001

(54) EXTRUDED TRIM SYSTEM FOR CERAMIC TILE WALL

(76) Inventor: Stephen Shipton, 1805 Cedar Ct., Warrington, PA (US) 18976

( * ) Notice: Subject to any disclaimer, the term of this patent is extended or adjusted under 35 U.S.C. 154(b) by 0 days.

(21) Appl. No.: 09/467,987

(22) Filed: Dec. 21, 1999

(51) Int. Cl.[7] ..... E04B 1/62

(52) U.S. Cl. ..... 52/287.1; 52/288.1; 52/716.1; 52/716.2; 52/506.01

(58) Field of Search ..... 52/287.1, 288.1, 52/716.1, 716.2, 716.3, 717.05, 747.11, 272, 274, 254, 386, 387, 506.01

(56) References Cited

U.S. PATENT DOCUMENTS

| | | | | |
|---|---|---|---|---|
| 642,778 | * | 2/1900 | Baer | 52/287.1 |
| 2,007,244 | * | 7/1935 | Gathercoal | 52/288.1 |
| 2,253,489 | * | 8/1941 | Smith | 52/287.1 |
| 3,092,869 | * | 6/1963 | Stump | 52/287.1 |
| 3,228,165 | * | 1/1966 | Begian | 52/287.1 |
| 3,549,471 | * | 12/1970 | Denton | 52/287.1 |
| 3,999,344 | * | 12/1976 | Jansen | 52/265 |
| 4,627,204 | * | 12/1986 | Smith | 52/233 |
| 5,040,346 | * | 8/1991 | White | 52/287 |
| 5,918,437 | * | 7/1999 | Dobija | 52/506.01 |
| 5,960,600 | * | 10/1999 | Monaco | 52/287.1 |

* cited by examiner

*Primary Examiner*—Carl D. Friedman
*Assistant Examiner*—Phi Dieu Tran A

(57) ABSTRACT

A water-proof wall trim system for an interior building wall includes a baseboard trim element which is affixed directly to the wall studs and which abuts the floor underlayment. A tongue extends from the top of the baseboard trim an abutment with the bottom edge of wallboard. The depth of the tongue is equal to the depth of the wallboard so that a flush joint between the wallboard and trim is formed. A wallboard covering element, such as tile or paneling may then be laid over the front face of the tongue and the wallboard which are co-planar. This covers over the flush joint to ensure a water-tight seal, preventing any wash-water from reaching the joint between the wallboard and top edge of the baseboard trim. The baseboard trim further includes a sloping incline portion at the top and a front face which extends from the bottom of the incline to the floor covering. The baseboard preferably also includes a notch in its base to receive the upturned edge of the floor covering, such as the edge of an interior cove tile. The baseboard trim is a plastic extrusion, preferably composed of polyvinylchloride.

9 Claims, 1 Drawing Sheet

EXTRUDED TRIM SYSTEM FOR CERAMIC TILE WALL

FIELD OF THE INVENTION

The present invention relates to an interior molding system which provides a water-proof trim element along a wall. More specifically, it relates to an extruded plastic baseboard that may be used in conjunction with tile or paneling to provide a water-proof yet high-impact baseboard.

BACKGROUND OF THE INVENTION

In many commercial work spaces the surfaces of the floors and walls are finished to provide a finish which can be easily and effectively cleaned. Most commonly, this surface is covered with ceramic tile, quarry tile or paneling which is commonly cleaned with high-pressure water and detergents. Ceramic tile is most often used along the walls and floors. The area along the base of the wall often receives the impact of skids and dollies which would otherwise crack the ceramic tile. A high-impact trim piece is added to replace the surface tile in this area.

There is a problem, however, because the joints between the baseboard and the adjoining wall and floor tiles are often not sufficiently water-tight against the wash-water especially if high-pressure washing is used. Leakage behind the baseboard often results in water damage to the tile and supporting drywall which then must be replaced. Also, water may leak through the wall into other areas of the building. The use of epoxy covered baseboard materials to overlap the joint between the wall tile and the floor at the base of the wall is known. However, the use of coating baseboard materials, such as, wood with epoxy in order to achieve water-tight surface is both expensive and time-consuming. It is further known to have thermo-plastic baseboards extruded into different decorative configurations. However, by design and in use, these plastic materials are applied as the final step over the surface tile. This invariably exposes a seam along the top edge of the baseboard trim which is susceptible to leaking wash-water to the area behind the baseboard. In a further attempt to mitigate this problem, the top edge of overlaid baseboard trim pieces is often angled downward along the top edge in order to facilitate the run-off of wash-water. However, because the trim piece is laid over the wall tile, water washing down the wall directly impacts the joint along the top of the baseboard, and leakage behind the baseboard still occurs. It is also known to use ceramic wall tile with a cove along the bottom edge where it meets the floor, however, the grout joint at base of the wall floor often washes out and water still gets behind the bottom coarse of tile. Finally, it is also known to overlay a single row of coved quarry tile as a base trim which sits directly on the floor tile, however, this still leaves a horizontal joint along the top edge of the quarry tile which is susceptible to water damage from above.

Despite all the efforts explained above, there is no known prior art baseboard trim system which provides and adequately meets the need for a long-lasting water-tight wall/floor joint. Extruded baseboard systems, such as U.S. Pat. No. 5,901,514 issued to Wolfe on May 11, 1999 disclose such a baseboard which is affixed directly to the wall sub-structure. However, in this instance, such as in all prior art systems, there is still an exposed seam along the top edge of the baseboard which is susceptible to wash-water leakage.

There is therefore a need in the art for an inexpensive and effective high-impact type baseboard which may be applied and used in a way which provides a water-tight seal against high-pressure wash-water coming from all directions, especially from above.

SUMMARY OF THE INVENTION

In order to meet the need in the art as described above, the present invention was devised, which comprises a unitary length of extruded plastic trim designed to be used in conjunction with the wall structure and the tiled area around it so that effective water-proofing is achieved. These attributes are provided by a baseboard trim which has a vertically extending front portion along its top most edge designed to be laid underneath the wall tile or paneling. The depth of the top portion is the same dimension as the drywall underlayment which abuts the top edge of the baseboard. Therefore, the wall tile or paneling may be laid over the surface of the drywall and directly onto the top surface of the baseboard, thereby bridging and sealing-over the wallboard/baseboard joint. As further disclosed, a wallboard covering element, such as wall tile or panel is laid down over the baseboard to a point where the baseboard angles outwardly and downwardly along an incline. The incline terminates along the top edge of a vertical front face of the baseboard that extends from the bottom most edge of the incline to the bottom edge where the baseboard meets the floor or floor tile. In typical installations, the floor is also tiled and, in that case, the baseboard may include a notch along its base to receive the edge of a floor tile which is upwardly extending. In this case, an interior cove base tile can be used for this purpose laid along the perimeter of the floor. The notch preferably extends through the front vertical face to accept the height of the floor tile. In any event, the rear surface of the baseboard is easily fastened directly against the wall studs which support the drywall.

More specifically, the applicant has invented a wall tile trim system comprising a vertical interior building wall with a wallboard affixed to the wall and a baseboard trim affixed directly to the wall studs which abuts the floor. The baseboard trim includes a first portion along a top edge which abuts a bottom edge of the wallboard with a flush joint between the wallboard and the trim formed by the first portion of the trim and the wallboard being of equal depth. A wall covering element is adhesively affixed to the wallboard and the first portion of the trim overlapping the flush joint.

According to these relations, a wall covering element, such as tile overlaps the baseboard which in turn overlaps the edge of the floor tile and therefore no joint between the wall tile and the baseboard or the baseboard and the floor may be impinged on by water from above. Thus, proper water drainage and run-off is ensured without the possibility of accumulation of residual water along any joint. Furthermore, because the baseboard material may be composed of a high-impact plastic, it is not easily damaged by contact with movable objects in the room. Other advantages of the present invention will be readily apparent from the following drawings and detail description of the preferred embodiment.

DESCRIPTION OF THE PREFERRED EMBODIMENT

Figure 1:
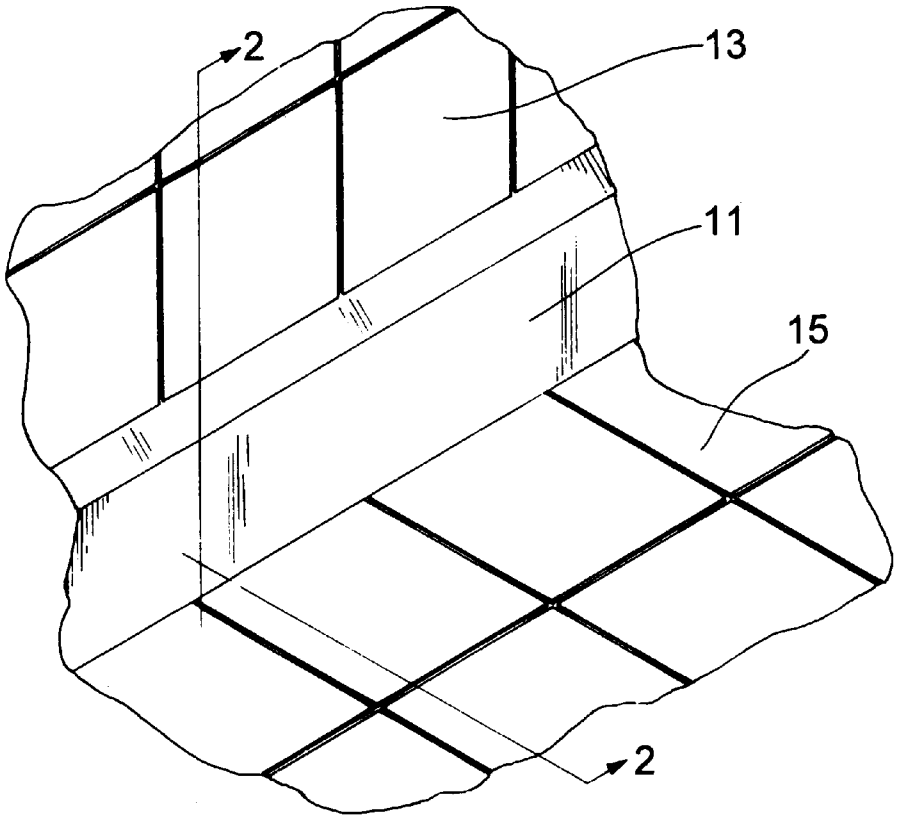
FIG. 1 is a top left isometric view of the present invention trim system.

Referring to FIG. 1, a typical work space is shown wherein both wall and floor surfaces are tiled to provide water-proof, washable surfaces to ensure a clean environment in the work space. The trim 11 in this embodiment is shown installed at the baseboard level at the bottom of wall 13 at points along its base where it meets the floor 15.

Figure 2:
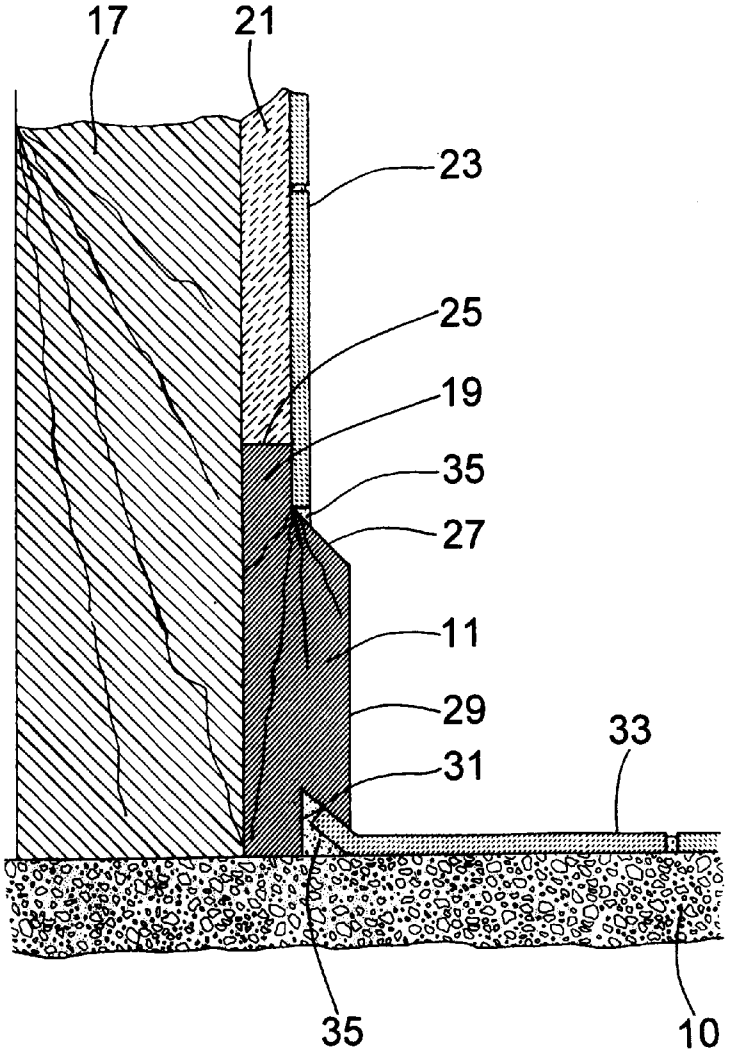
FIG. 2 is a side sectional view taken from FIG. 1 showing structural configuration of the trim system of the present invention and its relation to other building structures on which it is installed.

Referring now to FIG. 2, the present invention is shown in relation to its adjoining floor 10 and the wall studs 17. The baseboard trim 11 of the present invention is a unitary piece of extruded plastic material, preferably polyvinylchloride, which is applied directly against the wall studs 17. The trim is affixed with its back side 22 in abutment with the wall studs 17 by fasteners, such as, screws (not shown). The trim piece includes an upward extending tongue 20, which is equal to the depth of the adjoining wallboard 21. Therefore, a flush joint 25 between the front of the wallboard and the front face of the tongue 19 is created. This structure permits a wallboard covering element, such as wall tile 23 to overlap the wallboard/trim joint. This both seals the joint and provides an overlapping relation between the wall tile and the trim so that the trim joint is not exposed and wash-water running down the face of the wall tile. In the present invention the wash-water runs directly off the front of the trim onto the floor. In order to facilitate the run-off, the trim includes incline 27 and a vertical front face 29 of the trim provides a convenient impact bumper against movable objects in the work space. The bottom of the trim may include a notch 31 which in an alternate embodiment may be included to receive the upturned edge of a floor tile 33, an interior cove tile. The notch preferably extends through the front vertical face of the trim to accept the height of the floor tile as shown in this figure. All areas between the trim and the tile are filled with grout or silicone 35 applied as needed.

From the foregoing drawings and the description of the preferred embodiment, it will be readily understood that the objectives of the present invention have been met. There may be obvious modifications and adaptations as required for a particular application of the invention; however, the invention should be only limited in scope only by the following claims and their legal equivalents.

What is claimed is:

1. A wall trim system, comprising;

a vertical interior building wall;

a wallboard affixed to the wall;

a baseboard trim affixed directly to said wall and abutting a floor, said trim including a first portion along the top of the front of said trim abutting a bottom edge of said wallboard;

a flush joint between said wallboard and said trim formed by said first portion of said trim being of a depth equal to the depth of said wallboard; and a wall covering element affixed to said wallboard and said first portion of said trim, said element overlapping said flush joint, wherein said first portion of said trim is an upwardly extending tongue, said tongue having a front face being said first portion to which said covering element is affixed;

wherein said trim further includes an incline extending forwardly and downward from a bottom edge of said first portion.

2. The wall trim system of claim 1 further including a vertical face along the front side of the trim along the bottom, said front vertical face extending downward from a bottom edge of said incline.

3. The wall trim system of claim 2 wherein said first portion is parallel to a back side of said trim.

4. The wall trim system of claim 3 wherein a bottom side of said trim includes a notch which receives the upturned edge of a ceramic tile which is affixed to said floor.

5. The wall trim system of claim 4 wherein said notch extends forwardly through said vertical front face.

6. The wall trim system of claim 5 wherein said trim is composed of an extruded plastic material.

7. The wall trim system of claim 6 wherein said plastic material is polyvinylchloride.

8. The wall trim system of claim 7 wherein said trim is attached to the wall by screws.

9. The wall trim system of claim 8 wherein said covering element is a ceramic tile.

* * * * *